US009414479B2

(12) United States Patent
Lambert et al.

(10) Patent No.: US 9,414,479 B2
(45) Date of Patent: Aug. 9, 2016

(54) APPARATUS FOR PRODUCING A RADIOISOTOPE COMPRISING MEANS FOR MAINTENANCE AND METHOD OF MAINTENANCE FOR SAID APPARATUS

(75) Inventors: Bernard Lambert, Leesburg, VA (US); Jean-Michel Geets, Couthuin (BE); Jozef J. Comor, Belgrade (RS); Djuro Jovanovic, Belgrade (RS)

(73) Assignee: Ion Beam Applications S.A., Louvain-la-Neuve (BE)

( * ) Notice: Subject to any disclaimer, the term of this patent is extended or adjusted under 35 U.S.C. 154(b) by 577 days.

(21) Appl. No.: 13/701,294

(22) PCT Filed: May 31, 2011

(86) PCT No.: PCT/EP2011/058926

§ 371 (c)(1),
(2), (4) Date: Mar. 11, 2013

(87) PCT Pub. No.: WO2011/151316

PCT Pub. Date: Dec. 8, 2011

(65) Prior Publication Data

US 2013/0163708 A1 Jun. 27, 2013

(30) Foreign Application Priority Data

Jun. 1, 2010 (EP) ..... 10164664

(51) Int. Cl.
*G21G 1/00* (2006.01)
*H05H 6/00* (2006.01)
(Continued)

(52) U.S. Cl.
CPC . *H05H 6/00* (2013.01); *G21G 1/10* (2013.01); *G21K 5/00* (2013.01); *G21G 2001/0015* (2013.01); *G21G 2001/0063* (2013.01); *Y10T 29/4973* (2015.01)

(58) Field of Classification Search
CPC ..... G21K 5/00; G21K 5/08; G21K 5/10
USPC ..... 376/202
See application file for complete search history.

(56) References Cited

U.S. PATENT DOCUMENTS 4,464,331 A 8/1984 Bezer et al.
4,829,190 A * 5/1989 Okamoto et al. ..... 250/492.3
(Continued)

FOREIGN PATENT DOCUMENTS

WO 00/19787 A1 4/2000

OTHER PUBLICATIONS

John R. Votaw et al., "A Theoretical Description of the Beam Induced Heating of Accelerator Target Foils." Nuclear Instruments and Methods in Physics Research, A281 (1989), pp. 216-223.
(Continued)

*Primary Examiner* — Jack W Keith
*Assistant Examiner* — Sharon M Davis
(74) *Attorney, Agent, or Firm* — Fitch, Even, Tabin & Flannery LLP

(57) ABSTRACT

The present invention relates to an apparatus for producing a radioisotope by irradiating a target fluid comprising a precursor of said radioisotope with a particle beam produced by a particle accelerator, the apparatus comprising: —a housing comprising a target cavity for receiving said target fluid, said housing having an opening for allowing the passage of the said particle beam into the said cavity; —a dual foil flange for closing said opening of the target cavity, said dual foil flange comprising: —a standoff comprising a central hole; —a first and a second foil able to allow the passage of the said particle beam and located respectively on a first side and a second side of the said standoff, covering the said central hole and forming a cooling cavity; —a first flange and a second flange for sealing respectively the said first and second foil on said standoff; —at least an inlet channel and at least an outlet channel, for flowing a cooling fluid through the cavity of the dual foil flange; —guiding means for positioning said dual foil flange in an in-line position in which a said foil is facing said opening of said housing.

14 Claims, 6 Drawing Sheets

(51) Int. Cl.
*G21K 5/00* (2006.01)
*G21G 1/10* (2006.01)

(56) References Cited

U.S. PATENT DOCUMENTS

| | | | | |
|---|---|---|---|---|
| 4,945,251 | A | 7/1990 | Bechtold et al. | |
| 4,959,550 | A * | 9/1990 | Kashiwagi et al. | 250/492.3 |
| 2010/0086095 | A1 * | 4/2010 | Ogasawara et al. | 376/202 |

OTHER PUBLICATIONS

"KIPROS 120", ZAG Zyklotron AG, Jan. 2010, Retrieved from the Internet: URL:http//www.zyklotron-ag.de/cms/upload/pdf/KIPROS_4pager_web.pdf [retrieved on Nov. 1, 2010], 5 pages.
International Search Report, International Application No. PCT/EP2011/058926, date of completion Aug. 18, 2011, 3 pages.
European Search Report, European Application No. EP 10 16 4664, dated Nov. 4, 2010, 8 pages.

* cited by examiner

APPARATUS FOR PRODUCING A RADIOISOTOPE COMPRISING MEANS FOR MAINTENANCE AND METHOD OF MAINTENANCE FOR SAID APPARATUS

CROSS REFERENCE TO RELATED APPLICATIONS

This application is a national phase application of International Application No. PCT/EP2011/058926, filed May 31, 2011, designating the United States and claiming priority to European Patent Application No. 10164664.4, filed Jun. 1, 2010, which is incorporated by reference herein.

TECHNICAL FIELD

The present invention relates to an apparatus for producing a radioisotope by irradiating a target fluid comprising a precursor of said radioisotope with a particle beam produced by a particle accelerator. More particularly, the present invention relates to an apparatus comprising means for an improved maintenance, and a method of maintenance of said apparatus.

DESCRIPTION OF RELATED ART

Radioisotopes used for medicine are generally produced by irradiation of a precursor of radioisotope by a particle beam. The particle beam is produced by a particle accelerator, generally a linear accelerator or a cyclotron able to produce a beam in an energy range of 10 to 50 MeV. When the precursor is under liquid or gaseous state, the precursor is comprised into a housing forming a target cavity, the housing having an opening which is closed by a metal foil. The metal foil is generally made of Havar, Molybdenum or Niobium and has a thickness from about ten to about hundred micrometers for supporting the thermal and mechanical stress and allowing the passage of the particle beam to reach the inside of the cavity with sufficient energy for initiating nuclear reactions with the precursor. The metal foil is advantageously comprised between the said target cavity and a cooling cavity in which is able to flow a cooling fluid directed towards the said metal foil. The cooling cavity is closed by a second foil made of any metal separating the cooling cavity from the vacuum of the particle accelerator.

Document WO2000019787 describes a target body having parts fitting with the exit of a particle accelerator, the target body comprising three target body portions:

- a first target body portion having a target cavity comprising the precursor of the radioisotope;
- a second target body portion comprising a cooling cavity closed by two metallic foils, said second target body portion in which flows a cooling fluid directed towards the said metallic foils, a first foil separating the said cooling cavity from the said target cavity, and a second foil in contact with a third target body portion;
- a third target body portion having a cavity under vacuum, said third target body portion fitting with the particle accelerator, the cavity of the third target body portion being separated from the cooling cavity by the said second foil.

The said first, second and third target body portions are screwed together by means of bolts. In case of any leakage, for example after the breaking of a metallic foil, the user has to dismantle a lot of parts of the target body for changing the broken window while an important loss of precursor gas and radioisotope occurs. During the exchange of the said foil, the user is exposed to radiations coming from the produced radioisotope and from activated parts of the target body such as the metallic foils. Such operation is time consuming and usually need long cooling down time of the target for decay of the by-product.

An apparatus named Kipros 120, for producing iodine-123 by irradiating 124-Xe with an accelerated proton beam, is manufactured and provided by ZAG Zyklotron AG, Hermann-von-Helmoltz-Platz 1, D-76344 Eggenstein-Leopoldshafen, Germany. Said apparatus comprises a target housing having an opening for allowing the passage of the particle beam and comprising gaseous 124-Xe as radioisotope precursor, a dual foil flange for closing the opening of the said target housing, and a rotatable robot arm for positioning the said dual foil flange in an in-line position in front of the opening of the target housing. A dual foil flange is an appellation for a device comprising two irradiation foils able to allow the passage of a particle beam, a first and a second foil being located respectively on a first and a second side of a hollowed standoff, said first and second foil covering the hole of the standoff and forming a cooling cavity. The said first and second foils are maintained on the said standoff respectively by a first and a second flange. The dual foil flange further comprises an inlet channel for bringing a cooling fluid into said cooling cavity and an outlet channel for the evacuation of the said cooling fluid outside of the said cooling cavity. In the said apparatus named Kipros 120, the inlet and outlet channels are located on the said standoff. Flexible cooling gas pipelines, for flowing a cooling gas through the said cooling cavity, are fixed on the branches of said robot arm. The branches of said robot arm are actuated by means of an air-compressed system for clutching the standoff of said dual foil flange or for releasing the dual foil flange. The said robot arm is rotatable around an axis parallel to the axis of the particle beam for bringing the said dual foil flange from a first loading position to a in-line position in front of the target cavity and from said in-line position to a third position wherein the branches of the robot arm release the said dual foil flange into a shielded box. After the releasing of the dual foil flange, the robot arm returns to its initial loading position.

In case of a production run of a radioisotope, if a window foil gets broken, a cryogenic system traps the target fluid and the dual foil flange is evacuated to said shielded box. Then a user has to enter into the room comprising the apparatus for replacing a new dual foil flange into the branches of the robot arm of said apparatus. The replacement of an irradiation foil is faster with such an apparatus since no part has to be dismantled manually. Nevertheless, a first drawback is that the user has to enter in an unsafe high radiation area enclosing the said apparatus, comprising an amount of produced radioisotope in the target or trap. A second drawback is that the time during which the user replaces a dual foil flange is still time consuming. A third drawback is that the said robot arm of the apparatus is a complicated and encumbered device comprising:

- an air-compressed system comprising two flexible gas ducts adapted to maintain a pressure on the said branches for maintaining the dual foil flange and;
- the said flexible cooling pipelines.

Flexible ducts and pipelines are subject to move and are submitted to some mechanicals constraints. Therefore some leaks could occur in those pieces during the use of the apparatus. These flexible ducts and pipeline are not easily accessible and the detection and reparation of a leak in the apparatus is also time-consuming.

It is an object of our invention to provide an apparatus for producing a radioisotope wherein the maintenance of a dual foil flange is safer.

It is a further object of our invention to provide an apparatus wherein the maintenance of a dual foil flange is faster than in the apparatuses of the prior art.

It is a further object of our invention to provide an apparatus for producing a radioisotope having simplified means for changing a dual foil flange avoiding down time in production.

SUMMARY OF THE INVENTION

According to a first aspect, the invention relates to an apparatus for producing a radioisotope by irradiating a target fluid comprising a precursor of said radioisotope with a particle beam produced by a particle accelerator, the apparatus comprising:

- a housing comprising a target cavity for receiving said target fluid, said housing having an opening for allowing the passage of the said particle beam into the said cavity;
- a dual foil flange for closing said opening of the target cavity, said dual foil flange comprising:
  - a standoff comprising a central hole;
  - a first and a second foil able to allow the passage of the said particle beam and located respectively on a first side and a second side of the said standoff, covering the said central hole and forming a cooling cavity;
  - a first flange and a second flange for sealing respectively the said first and second foil on said standoff;
  - at least an inlet channel and at least an outlet channel, for flowing a cooling fluid through the cavity of the dual foil flange;
- guiding means for positioning said dual foil flange in an in-line position in which a said foil is facing said opening of said housing;

the apparatus being characterized in that the said guiding means are adapted to transfer said dual foil flange through a translation movement, from a stand-by position to the said in-line position.

In a preferred embodiment of the invention, said guiding means are adapted to evacuate a defective or dated dual foil flange through translation movements towards a discard position.

Preferably, said guiding means comprise parallel elongated parts in which a dual foil flange is able to slide.

Advantageously, the apparatus comprises means for moving the said housing following a direction parallel to the axis of the particle beam, said means for moving the said housing being able to position the said housing in two positions:

- a first position wherein the said opening of the housing is at a distance from the beam exit of the particle accelerator larger than the longitudinal length of the said dual foil flange, in order to have a space for inserting said dual foil flange in the said in-line position or for evacuating said dual foil flange from said in-line position;
- a second position wherein the said housing presses the said dual foil flange against the said beam exit of the particle accelerator.

Preferably, said means for moving the said housing comprise a lever being maintained at rest by a spring and being actionable by a piston able to exert a force opposite to the force exerted by the spring, in order to induce a movement on the said housing for retracting the said housing from the beam exit of the particle accelerator or from the said dual foil flange.

Preferably, said guiding means comprise means for moving the said parallel elongated parts following a direction parallel to the axis of the particle beam for providing a first space between said dual foil flange and the said beam exit of the particle accelerator and a second space between said dual foil flange and the opening of the said housing, when said housing is positioned at said first location.

Preferably, said inlet and outlet of the said dual foil flange have their first extremity located on a flange and their second extremity located on the standoff, said second extremities being directed towards the inside of the said cooling cavity.

Advantageously, the apparatus comprises a first fixed gas pipeline having a fixed extremity connectable with the extremity of the said inlet channel of said dual foil flange and a second fixed gas pipeline connectable with the extremity of the said outlet channel of the said dual foil flange for flowing the said cooling fluid inside the said cooling cavity when said dual foil flange is compressed between said beam exit of the particle accelerator and the said opening of the housing.

Advantageously, the apparatus comprises a charger having the capacity for containing at least one dual foil flange and able to position the said dual foil flange into the said parallel elongated parts.

Advantageously, the apparatus comprises monitoring means able to detect any leakage.

More advantageously, the apparatus comprises means for trapping the said target fluid in case of any detection of a leakage by the said monitoring means.

Preferably, the apparatus comprises a program able to start in case of any leakage detected by the said monitoring means, said program being adapted for performing the steps of:

- actuating the said means for trapping the said target fluid;
- when the said target fluid is trapped, transferring the said dual foil flange to the said discard position;
- transferring a new dual foil flange from the said stand-by position to the said in-line position.

A second aspect of the present invention relates to a dual foil flange for closing the opening of a housing destined to contain a fluid comprising a precursor of radioisotope, said dual foil flange comprising:

- a standoff comprising a central hole;
- a first and a second foil able to allow the passage of a particle beam, located respectively on a first and a second side of the said standoff, covering the said central hole and forming a cooling cavity;
- a first flange and a second flange for sealing respectively the said first and second foil on said standoff;
- an inlet channel and an outlet channel for flowing a cooling fluid through the said cooling cavity;

characterized in that the said inlet and outlet channels have their first extremity located on a flange and their second extremity located on the said standoff, said second extremities being directed towards the inside of the cooling cavity.

The invention also relates to a method for replacing a dual foil flange closing the opening of a housing comprising a target material, comprising the steps of:

- Trapping the said target fluid;
- Evacuating the said dual foil flange from its position closing the said opening of the housing to a storage position;
- Transferring another dual foil flange from another storage position to the said position closing the said opening of the housing;

characterized in that the said method is fully automated.

Advantageously, said dual foil flanges are evacuated or transferred using a gravity effect.

Preferably, the method according to the invention uses a dual foil flange an apparatus as detailed hereabove.

DETAILED DESCRIPTION OF THE INVENTION

Figure 1:
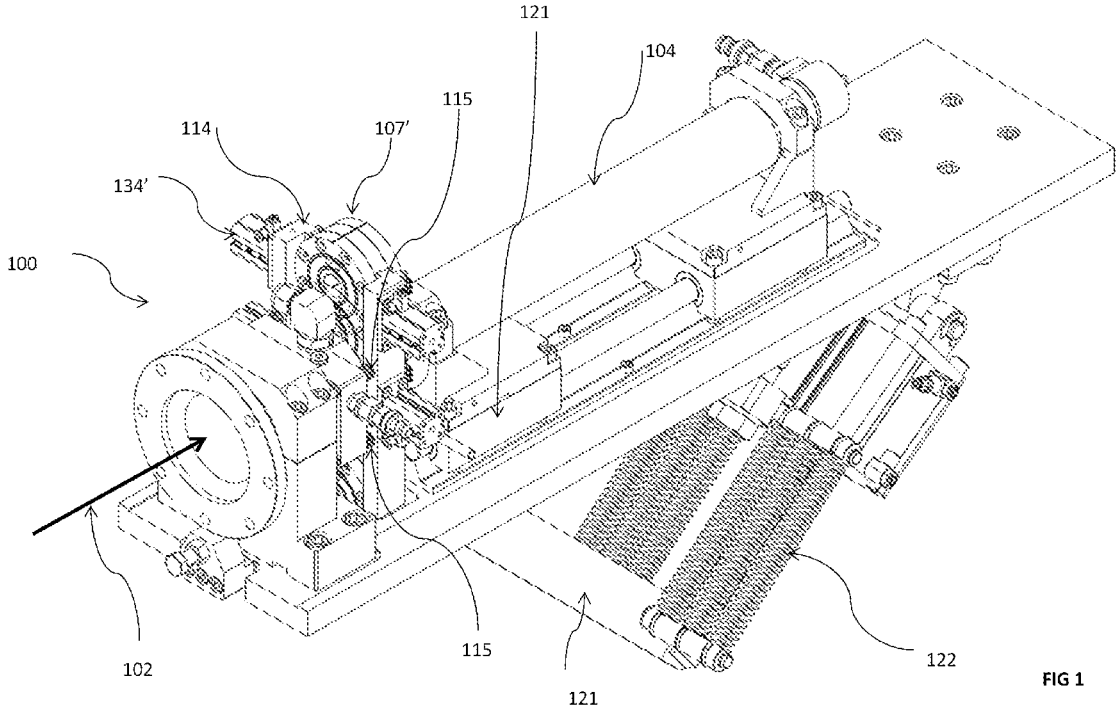
FIG. 1 is a three-dimensional view of an apparatus according to the present invention.
Figure 2:
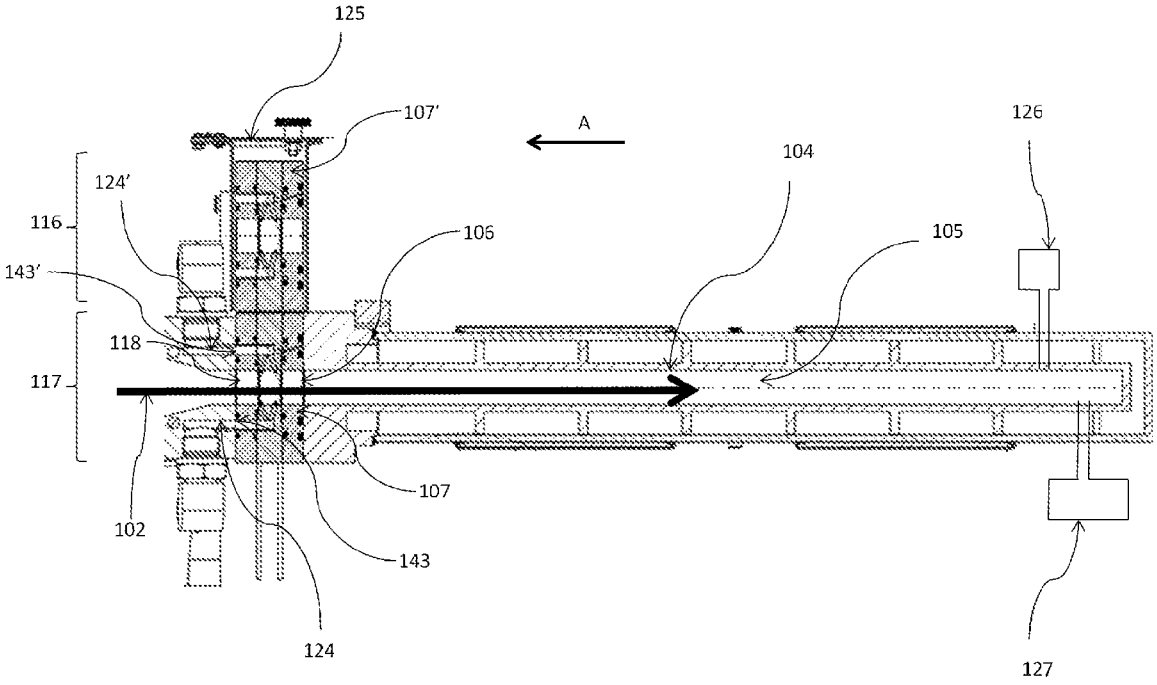
FIG. 2 shows a cross sectional partial view of an apparatus according to the invention.

FIG. 1 shows a three-dimensional view of an apparatus 100 for producing a radioisotope by irradiating a target fluid comprising a precursor of said radioisotope with a particle beam 102 produced by a particle accelerator. FIG. 2 shows a cross sectional view along the axis of the particle beam 102 of some parts of the apparatus of our invention. The apparatus of our invention comprises:

- a housing 104 enclosing a target cavity 105 for receiving said target fluid, said housing 104 having an opening 106 for allowing the passage of the said particle beam 102 into the said cavity 105;
- a dual foil flange 107 for closing said opening 106 of the cavity,
- guiding means for positioning said dual foil flange 107 in an in-line position 117 between said opening 106 of said housing 104 and the beam exit 118 of the particle accelerator.

Figure 3:
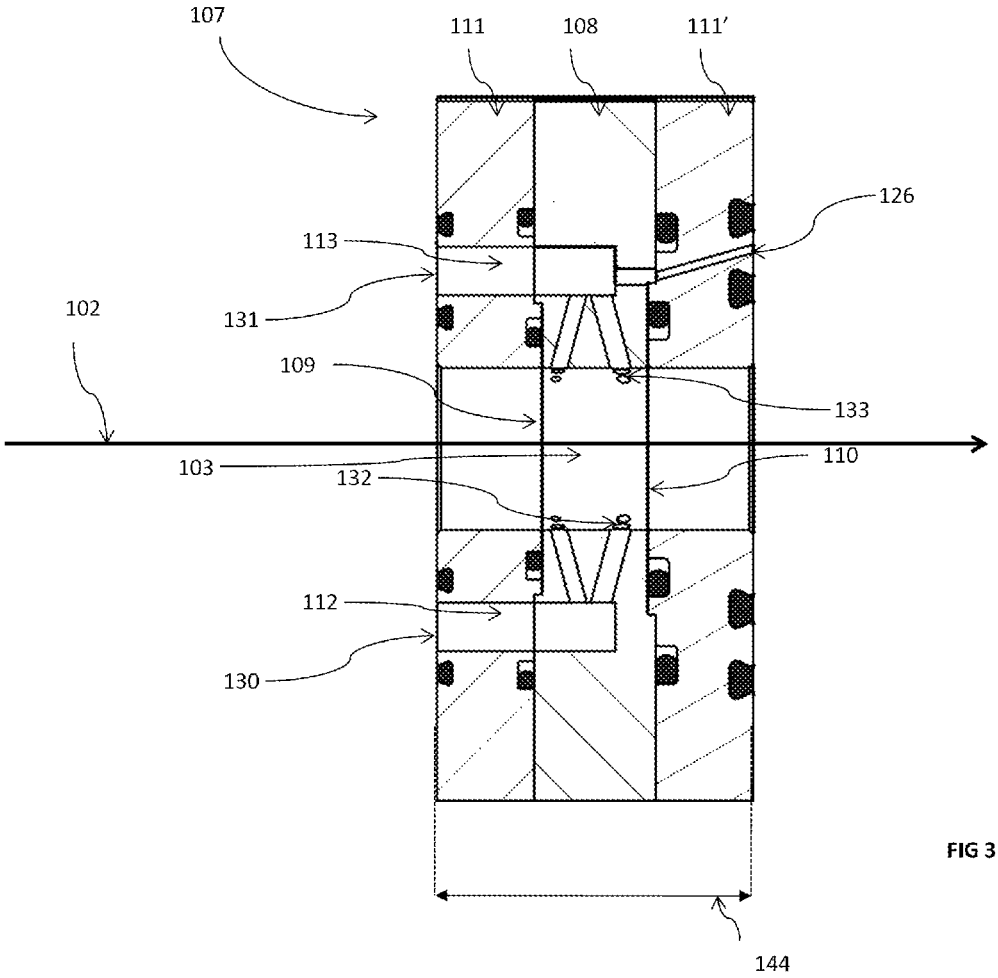
FIG. 3 shows a cross sectional view of a dual foil flange comprised in an apparatus according to the present invention.

FIG. 3 shows a cross sectional view of a dual foil flange 107 for use in the apparatus of our invention. Said dual foil flange comprises:

- a standoff 108 comprising a central hole;
- a first and a second foil 109, 110 able to allow the passage of a particle beam 102, located respectively on a first and a second side of the said standoff 108, covering the said central hole and forming a cooling cavity 103;
- a first flange 111 and a second flange 111' for sealing respectively the said first and second foil 109, 110 on said standoff;
- an inlet channel 112 and an outlet channel 113, for flowing a cooling fluid through the said cooling cavity 103.

The said dual foil flange 107 is characterized in that the said inlet channel 112 and outlet channels 113 have a first extremity respectively 130, 131 located on a flange 111 and/or 111' and at least another extremity respectively 132, 133 located on the standoff 108 and directed through the inside of the cooling cavity 103.

Figure 4:
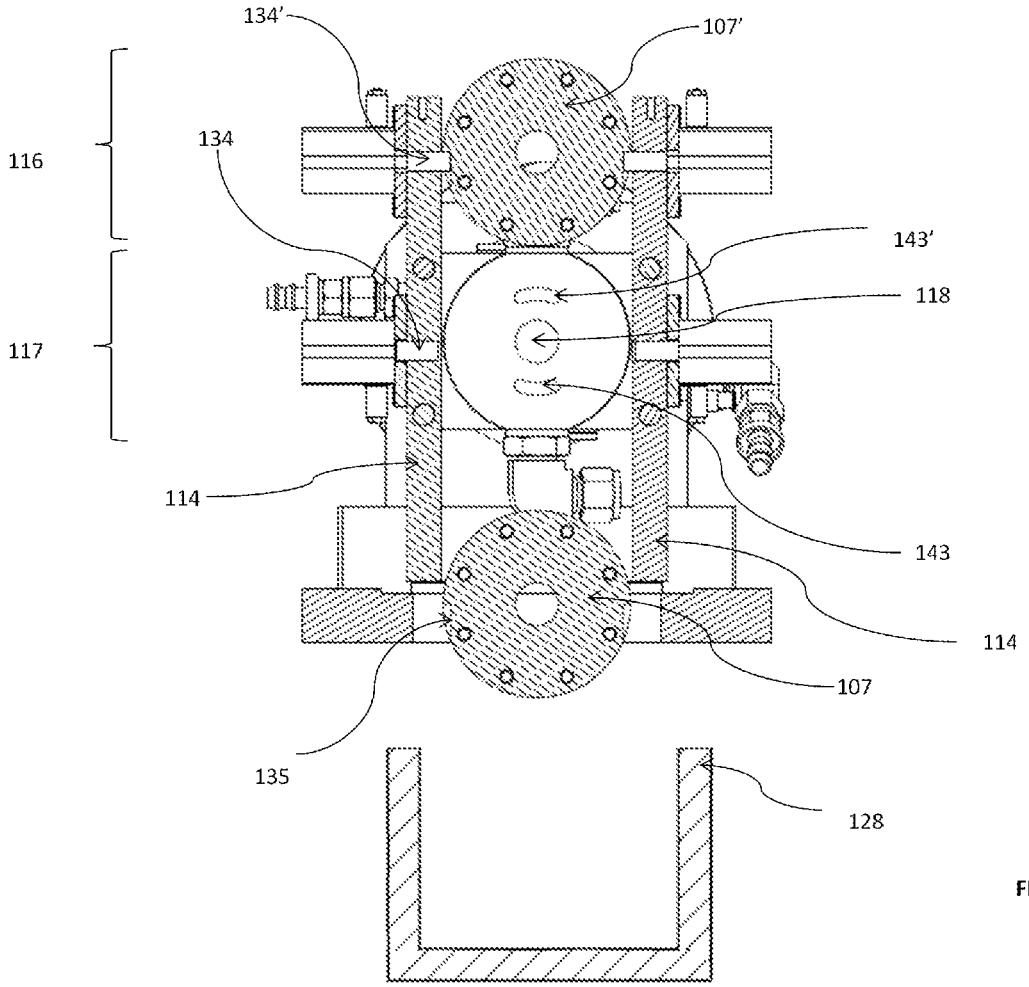
FIG. 4 is a view in the direction of arrow A of FIG. 2 of dual foil flanges into guiding means of the apparatus for transferring a dual foil flange from a stand-by position to a in-line position and from said in-line position to a discard position.

FIG. 4 shows a view in the direction of arrow A of FIG. 2 of a first dual foil flange 107 and a second dual foil flange 107' into the said guiding means. Said guiding means are adapted for transferring said dual foil flanges 107, 107' through translation movements from a stand-by position 116 to an in-line position 117 and from said in-line position 117 to a discard position 128. Said guiding means comprises parallel elongated parts 114 in which a dual foil flange 107 is able to slide. Said guiding means further comprises actionable blocking means 134', for blocking a dual foil flange 107' in said stand-by position 116 and blocking means 134 for blocking a dual foil flange 107 into said in-line position 117. In an embodiment of our invention, the said dual foil flange comprises notches 135 for allowing the said blocking means 134, 134' to maintain the said dual foil flange 107, 107'. Various means for blocking said dual foil flange 107, 107' may be easily realized by a man skilled in the art.

Said guiding means are adapted to evacuate a defective or dated dual foil flange through translation movements towards a discard position 128, advantageously into a shielded enclosure.

Figure 5:
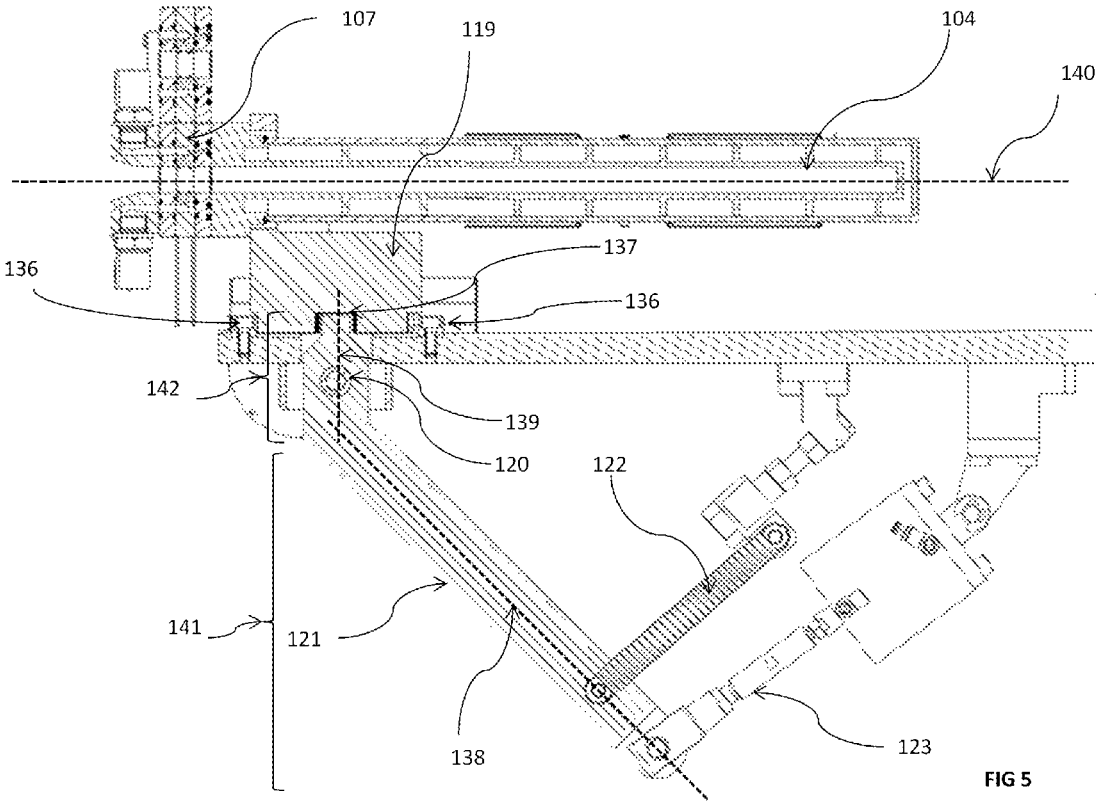
FIG. 5 is a view of an apparatus according to the invention where the means for moving a housing of the apparatus are at rest position.
Figure 6:
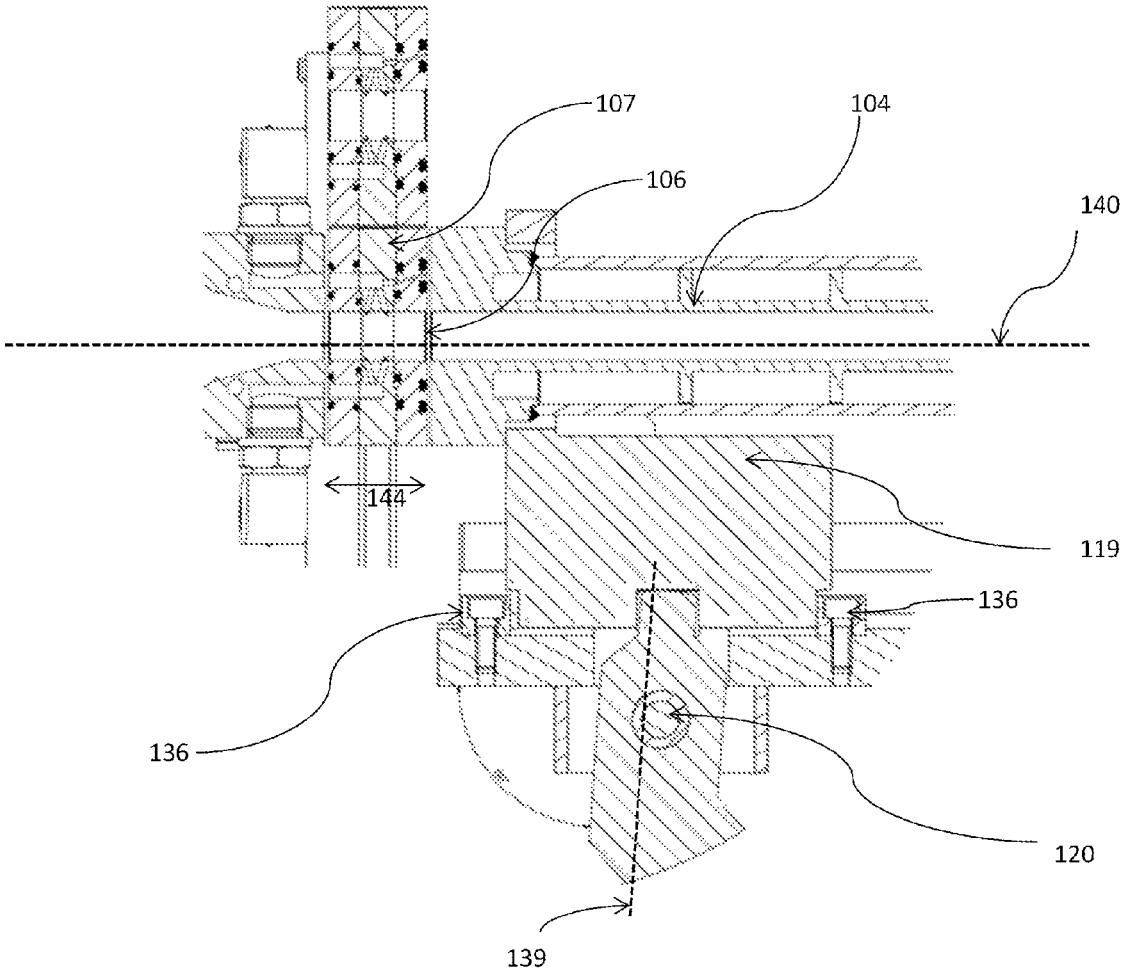
FIG. 6 is a enlarged view of the a part of the means for moving the said housing when said means for moving said housing is actuated.

The apparatus of our invention further comprises a means for moving the said housing 104 following a direction parallel to the axis of the said particle beam 102. Said means for moving the said housing 104 is able to position the said housing 104 in two positions:

- a first position (actuated position) as shown on FIG. 6, wherein the said opening 106 of the housing 104 is at a distance from the beam exit 118 of the particle accelerator, said distance being longer than the longitudinal length 144 of the dual foil flange 107, in order to have sufficient space to insert said dual foil flange 107 in the said in-line position 117 or to evacuate said dual foil flange from said in-line position 117 to said discard position 128;
- a second position (rest position) as shown on FIG. 5, wherein the said housing 104 presses the said dual foil flange 107 against the said beam exit 118 of the particle accelerator.

Said means for moving the said housing may comprise for example a piston located backwards the said housing, following the arrow A of FIG. 2. FIG. 5 shows an embodiment of our invention wherein said means for moving the said housing comprises a lever 121 being maintained at rest by a spring 122 and being actionable by a piston 123. Said piston 123 is able to exert a force opposite to the force exerted by the spring 122, in order to induce a movement on the said housing 104 for retracting the said housing 104 from the said dual foil flange 107. Both said spring 122 and said piston 123 are fixed near the extremity of the said lever 121. Said lever 121 has a main elongated part 141 having a longitudinal axis 138 inclined respect to the longitudinal axis 140 of the housing 104, and a shorter part 142 comprising a pivot 120 and having a longitudinal axis 139 perpendicular to the longitudinal axis 140 of the housing 104. The housing 104 comprises a member 119 able to slide between two abutments 136. Said member 119 comprises a notch 137 in which is inserted the said smaller part 142 of the lever 121. FIG. 6 shows an enlarged view of the said smaller part 142 of the lever 121 and the said member 119 in a configuration in which the lever 121 is actuated by the said piston 123. The said longitudinal axis 139 of the said smaller part 142 of the lever 121 makes an angle of less than 90° with the axis of the said housing, retracting the said housing 104 from the said dual foil flange 107.

Said guiding means comprises means for moving the said parallel elongated parts 114 in the direction of the axis of the particle beam. When the said housing is in the said first position (actuated position), said parallel elongated parts 114 are located in a manner that a first side of the said dual foil flange is separated from the said beam exit 118 of the particle accelerator and the second side of the said dual foil flange is separated from the opening of the housing, in order that the insertion in the said in-line position or the evacuation from said in-line position of a dual foil flange is facilitated.

When the housing 104 is in the second position (rest position), pressing the said dual foil flange, the said parallel elongated members 114 are moved towards the said beam exit 118 of the particle accelerator, in a manner that the said dual foil flange 107 is tightly compressed between the said housing 104 and the said beam exit 118 of the particle accelerator.

For example, said means for moving the said elongated parts 114 may comprise a motor moving the said parallel elongated parts 114 following both direction along the axis of the particle beam 102, or may comprise a spring 115 having a first extremity fixed on said parallel elongated parts 114 and a second extremity fixed in a plan parallel to the said beam exit 118 of the particle accelerator.

Referring to FIGS. 2, 3 and 4, the apparatus of our invention further comprises a first fixed gas pipeline 124 having a fixed extremity 143 connectable with the extremity 130 of the inlet channel 112 of the said dual foil flange, and a second fixed gas pipeline 124' having a fixed extremity 143' connectable with the extremity 131 of the outlet channel 113 of the said dual foil flange 107. Said fixed gas pipelines 124, 124' provide a flow of cooling fluid inside said cooling cavity 103 when said dual foil flange is compressed between said beam exit 118 of the particle accelerator and said opening 106 of the housing 104. Advantageously, said fixed connections 143 are located on a surface in the plan of said beam exit 118 of the particle accelerator, in a manner that the compression of the dual foil flange 107 between the said housing 104 and the said beam exit 118, provides a tight sealing between the extremities 143, 143' of the fixed gas pipelines 124, 124' with the extremities 130, 131 of the inlet and outlet channels of the dual foil flange 107.

The apparatus of our invention further comprises a charger 125 having the capacity for containing at least one dual foil flange 107' in a stand-by position 116. Said charger 125 is able to position the said dual foil flange 107 into the said parallel elongated parts 114. Advantageously, said charger comprises the said elongated parts 114 and the said actionable blocking means 134', for blocking a dual foil flange 107' into said stand-by position 116.

Referring to FIGS. 2 and 3, the apparatus of our invention further comprises monitoring means 126 able to detect any leakage. Said monitoring means 126 may be a pressure controller or a radiation monitor connected to the cooling cavity 103 of the dual foil flange and/or to the target cavity 105 of the housing 104. Advantageously, both a pressure controller and a radiation monitor are used as monitoring means.

The apparatus of our invention further comprises means for trapping 127 the target fluid comprised into the target cavity 105 of the housing 104. Said means for trapping 127 is actionable in case of any leakage detected by the said monitoring means 126, in order to avoid the dispersion of precursor and radioisotope in the apparatus and the atmosphere.

The apparatus of our invention further comprises a program able to start in case of any leakage detected by the said monitoring means 126. Said program is adapted for performing the steps of:

- actuating the said means for trapping 127 the said target fluid;
- when the when the said target fluid is trapped, transferring the said dual foil flange 107 to the said discard position 128;
- transferring a new dual foil flange 107 from the said stand-by position to the said in-line position.

Example of Utilization of the Apparatus of the Present Invention a) Loading of a Dual Foil Flange 107

A first dual foil flange 107 is located in the said stand-by position 116 in a charger 125. In a first step, the means for moving the said housing 104 is actuated in order to retract the said housing 104 from the said beam exit 118 of the particle accelerator. Said parallel elongated parts 114 are maintained separated from the said beam exit 118 of the particle accelerator by a spring 115. In a second step, the said blocking means 134' blocking said dual foil flange 107' into said stand-by position 116 are deactivated while the said blocking means 134 for blocking said dual foil flange 107 into the said in-line position 117 are actuated. Said dual foil flange 107 slides into the said parallel elongated members 114 and falls down in the said in-line position by gravity. In a third step, said means for moving the said housing 104 is deactivated in order to press the said housing 104 against the said dual foil flange 107, pressing in the same time the said dual foil flange 107 against the beam exit 118 of the particle accelerator. In this configuration, both extremities 130, 131 of respectively the inlet channel 112 and the outlet channel 113, located on the flange 111 are connected to the said fixed gas connections 143, 143'. Then, said apparatus is ready for flowing a cooling fluid through the cooling cavity 103 of the dual foil flange and for the introduction of a target fluid into the target cavity 105 of the housing 104. Advantageously, a second dual foil flange 107' is positioned into said charger 125.

Advantageously, the said target fluid is in gaseous state and comprises a precursor of a radioisotope. For example, said target fluid may be 124-Xe for the production of 123-I by proton irradiation or 18-O for the production of 18-F by proton irradiation. A cooling fluid, for example helium, is able to flow through the cooling cavity of said dual foil flange 107, cooling the irradiation foils 109, 110 when they are submitted to the irradiation by the particle beam 102.

b) Replacing of a Dual Foil Flange 107

During a production run of radioisotope, if a monitoring means 126 detects a leakage coming from the dual foil flange 107, the means for trapping 127 the target fluid are actuated. Said means for trapping 127 the target fluid comprises for example a cryopump or storage vessel. Then, the means for moving the housing 104 are actuated in order to retract the said housing 104 from the said dual foil flange 107. Said spring 115 moves away the said parallel elongated members 114 from the beam exit 118 of the particle accelerator in order that the said dual foil flange 107 is separated from the said beam exit 118 and from the opening 106 of the housing 104. The said blocking means 134 maintaining the dual foil flange 107 into the said in-line position 117 are deactivated and the damaged dual foil flange falls down into a discard position 128, advantageously into a shielded enclosure.

The said second dual foil flange 107' already located into the said charger 125 is ready to be positioned in the in-line position in the same manner as the used first dual foil flange 107. When the said second dual foil flange 107' is in a ready position for restarting the production run of radioisotope, the trapping means reintroduces the trapped target fluid from the cryopump or storage vessel to the target cavity 105 of the housing 104. Then, the production run can restart.

The user can also choose a program for changing a dual foil flange periodically in order to avoid that a leakage in the dual foil flange occurs.

The apparatus of our invention provides some advantages respect to the prior art. Firstly the maintenance of the apparatus is improved since the method for replacing a dual foil flange is fully automated and does not require any manual intervention of the user. For that reason, said apparatus is safer for the user since he does not need to enter anymore in the high radiation area room enclosing the apparatus. The user is thus less susceptible to be submitted to radiations.

A second advantage is that the method provided by the apparatus for replacing a dual foil flange is fast due to the simplification of the guiding means for positioning the dual foil flange in the said in-line position. The time for changing a dual foil flange is also reduced due to the fully automation of the method.

Finally, the guiding means and cooling means for a dual foil flange are simplified and does not comprises any flexible gas pipelines. The dual foil flange is safely maintained into the said in-line position with the inlet and outlet channels tightly connected to fixed gas connections for flowing a cooling fluid though said dual foil flange.

The invention claimed is:

1. An apparatus for producing a radioisotope by irradiating a target fluid comprising a precursor of said radioisotope with a particle beam produced by a particle accelerator, the apparatus comprising:

a housing comprising a target cavity configured to receive said target fluid, said housing having an opening for allowing the passage of the particle beam into the cavity;

a dual foil flange device configured to close said opening of the target cavity, said dual foil flange device comprising:

a standoff comprising a central hole;

a first and a second foil that allow the passage of the particle beam and are located respectively on a first side and a second side of the standoff, covering the central hole and forming a cooling cavity;

a first flange and a second flange that seals respectively the first and second foil on said standoff;

at least an inlet channel and at least an outlet channel, through which a cooling fluid flows through the cavity of the dual foil flange device;

a guide for positioning said dual foil flange device in an in-line position in which a foil is facing said opening of said housing; wherein the guide is configured to transfer said dual foil flange device through a translation movement, from a stand-by position that is out-of-line with the particle beam, to the in-line position.

2. The apparatus according to claim 1, wherein the guide is configured to evacuate a defective or dated dual foil flange device through translation movements towards a discard position.

3. The apparatus according to claim 1, wherein the guide comprises parallel elongated parts in which a dual foil flange device is able to slide.

4. The apparatus according to claim 1, further comprising means for moving the housing following a direction parallel to an axis of the particle beam, said means for moving the housing being able to position the housing in two positions:

a first position wherein the opening of the housing is at a distance from a beam exit of the particle accelerator larger than a longitudinal length of the dual foil flange device, in order to have a space for inserting said dual foil flange device in the in-line position or for evacuating said dual foil flange device from said in-line position;

a second position wherein the housing presses the dual foil flange device against the beam exit of the particle accelerator.

5. The apparatus according to claim 4, wherein the means for moving the housing comprise a lever being maintained at rest by a spring and being actionable by a piston able to exert a force opposite to the force exerted by the spring, in order to induce a movement on the housing for retracting the housing from the beam exit of the particle accelerator or from the dual foil flange device.

6. The apparatus according to claim 3, wherein the guide comprises means for moving the parallel elongated parts following a direction parallel to an axis of the particle beam for providing a first space between said dual foil flange device and a beam exit of the particle accelerator and a second space between said dual foil flange device and the opening of the housing, when said housing is positioned at a first location.

7. The apparatus according to claim 1, wherein the inlet and outlet of the dual foil flange device have their first extremity located on a flange and their second extremity located on the standoff, said second extremities being directed towards the inside of the cooling cavity.

8. The apparatus according to claim 7, further comprising a first fixed gas pipeline having a fixed extremity connectable with an extremity of the inlet channel of said dual foil flange device and a second fixed gas pipeline connectable with an extremity of the outlet channel of the dual foil flange device for flowing the cooling fluid inside the cooling cavity when said dual foil flange device is compressed between a beam exit of the particle accelerator and the opening of the housing.

9. The apparatus according to claim 1, further comprising a charger having the capacity for containing at least one dual foil flange device and able to position the dual foil flange device into the parallel elongated parts.

10. The apparatus according to claim 1, further comprising a monitor configured to detect any leakage.

11. The apparatus according to claim 10, further comprising means for trapping the target fluid in case of any detection of a leakage by the monitor.

12. The apparatus according to claim 1, wherein the inlet and outlet channels have their first extremity located on a flange and their second extremity located on the standoff, said second extremities being directed towards the inside of the cooling cavity.

13. A method for replacing the dual foil flange device in the apparatus of claim 1, the method comprising:

Trapping the target fluid;

Evacuating the dual foil flange device from its position closing the opening of the housing to a storage position; and Transferring another dual foil flange device from another storage position to the position closing the opening of the housing;

wherein the method is fully automated, and wherein said transferring takes place by the translation movement from the stand-by, out-of-line position to the in-line position in which one of the foils is facing said opening of said housing.

14. The method according to claim 13 wherein the dual foil flange devices are evacuated or transferred using a gravity effect.

* * * * *